US006923733B2

(12) United States Patent
Chen

(10) Patent No.: US 6,923,733 B2
(45) Date of Patent: Aug. 2, 2005

(54) GOLF CLUB HEADS

(75) Inventor: Chan-Tung Chen, Kaohsiung (TW)

(73) Assignee: Fu Sheng Industrial Co., Ltd., Taipei (TW)

( * ) Notice: Subject to any disclaimer, the term of this patent is extended or adjusted under 35 U.S.C. 154(b) by 0 days.

(21) Appl. No.: 10/682,033

(22) Filed: Oct. 10, 2003

(65) Prior Publication Data

US 2005/0079927 A1 Apr. 14, 2005

(51) Int. Cl.[7] ..... A63B 53/02; A63B 53/04

(52) U.S. Cl. ..... 473/305; 473/326; 473/345; 473/349; 473/350

(58) Field of Search ..... 473/324–350, 473/305–315, 290–291

(56) References Cited

U.S. PATENT DOCUMENTS

| | | | | | |
|---|---|---|---|---|---|
| 1,414,124 | A | * | 4/1922 | Griffin | 473/242 |
| 1,529,009 | A | * | 3/1925 | Carpenter | 473/306 |
| 3,064,980 | A | * | 11/1962 | Steiner | 473/335 |
| 4,607,846 | A | * | 8/1986 | Perkins | 473/336 |
| 4,995,609 | A | | 2/1991 | Parente et al. | |
| 5,183,255 | A | | 2/1993 | Antonious | |
| 5,226,659 | A | * | 7/1993 | Lo | 473/348 |
| 5,230,510 | A | | 7/1993 | Duclos | |
| 5,312,106 | A | * | 5/1994 | Cook | 473/336 |
| 5,324,033 | A | | 6/1994 | Fenton, Jr. | |
| 5,326,106 | A | * | 7/1994 | Meyer | 473/305 |
| 5,377,978 | A | | 1/1995 | Lee | |
| 5,542,664 | A | * | 8/1996 | Mahaffey et al. | 473/305 |
| 5,601,498 | A | * | 2/1997 | Antonious | 473/305 |
| 5,607,363 | A | | 3/1997 | Chou | |
| 5,626,528 | A | | 5/1997 | Toulon | |
| 5,643,105 | A | | 7/1997 | Niswander | |
| 5,695,409 | A | * | 12/1997 | Jackson | 473/305 |
| 5,935,016 | A | * | 8/1999 | Antonious | 473/305 |
| 6,042,486 | A | * | 3/2000 | Gallagher | 473/329 |
| 6,431,995 | B1 | * | 8/2002 | Jackson | 473/305 |

* cited by examiner

*Primary Examiner*—Sebastiano Passaniti
(74) *Attorney, Agent, or Firm*—Birch, Stewart, Kolasch & Birch, LLP

(57) ABSTRACT

A golf club head includes a golf club head body, a striking plate mounted to the golf club head body, a hosel mounted to a side of the golf club head body, and a heel between the hosel and the striking plate. The heel includes a compartment for reducing a weight of the heel, thereby shifting a center of gravity of the golf club head toward a toe of the golf club head body and increasing an inertial moment of the golf club head. A filling material may be filled in the compartment for absorbing vibrations generated as a result of striking a golf ball.

13 Claims, 6 Drawing Sheets

GOLF CLUB HEADS

BACKGROUND OF THE INVENTION

1. Field of the Invention

The present invention relates to a golf club head. In particular, the present invention relates to a golf club head the weight of which is reduced for adjusting the center of gravity of the golf club head.

2. Description of Related Art

FIG. 1 of the drawings illustrates a typical golf club head 1 made of metal. The golf club head 1 includes a golf club head body 10, a striking plate 11, a heel 12, and a neck or hosel 13 to which a shaft (not shown) is mounted. The heel 12 connects the hosel 13 to the striking plate 11. The center of gravity 14 of the golf club head 1 is relatively close to the heel 12, as the heel 12 and the hosel 13 have considerable weights. Thus, the center of gravity 14 is not located in the sweet spot of the striking plate 11. As a result, the inertial moment of the golf club head 1 is reduced, and the momentum imparted from the golf club head 1 to the golf ball is thus reduced. The striking effect of the golf club head 1 is adversely affected accordingly.

U.S. Pat. No. 4,995,609 discloses an improvement in iron golf clubs in which a hollow hosel is provided to thereby reduce weight of hosel and bridge that can be redistributed to the blade to increase the momentum that can be imparted to a golf ball. In an embodiment of the U.S. Pat. No. 4,995,609, as illustrated in FIG. 2 of the drawings, the golf club head 1 includes a golf club head body 10, a striking plate 11, and a hosel 13 to which a shaft 15 is mounted. A step 101 is formed in a lower end of a heel 12 between the hosel 13 and the golf club head body 10 to reduce the weight of the hosel side, thereby shifting the center of gravity 14 toward the toe 16 of the golf club head 1; namely, outwardly away from the heel 12, thereby increasing the inertial moment of the golf club head 1 that would lead to improvement in the striking effect of the golf club head 1 (i.e., the flying distance of the golf ball). However, although the center of gravity 14 is shifted outwardly away from the heel 12 through provision of the step 101 of the golf club head 1, the step 101 adversely affects the structural strength of the heel 12 of the golf club head 1. Further, the weight of the lower portion of the golf club head 1 is reduced since the step 101 is located in the lower end of the heel 12. Thus, the center of gravity 14 of the golf club head 1 is not only shifted outwardly away from the heel 12 but also shifted upward. As a result, the sweet spot of the striking plate 11 is too high. Essentially, provision of the step 101 in the golf club head 1 neither improves the striking effect nor increases the inertial moment of the golf club head 1. Further, the possibility of breakage or twist of the golf club head 1 is increased.

U.S. Pat. Nos. 5,183,255; 5,230,510; 5,324,033; 5,377,978; 5,607,363; 5,626,528; and 5,643,105 disclose similar structures that include a recessed portion in either the heel or the hosel of the golf club head for shifting the center of gravity of the golf club head and thus have the same problems.

OBJECTS OF THE INVENTION

An object of the present invention is to provide a golf club head including a heel with a reduced weight to shift the center of gravity of the golf club head toward the toe of the golf club head, thereby increasing the inertial moment of the golf club head and improving the striking effect of the golf club head.

Another object of the present invention is to provide a golf club head with a strengthened structure.

A further object of the present invention is to provide a golf club head with a vibration-absorbing function.

SUMMARY OF THE INVENTION

According to one aspect of the invention, a golf club head includes a golf club head body, a striking plate mounted to the golf club head body, a hosel mounted to a side of the golf club head body, and a heel between the hosel and the striking plate. The heel includes a compartment for reducing a weight of the heel, thereby shifting a center of gravity of the golf club head toward a toe of the golf club head body and increasing an inertial moment of the golf club head. A filling material may be filled in the compartment for absorbing vibrations generated as a result of striking a golf ball.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
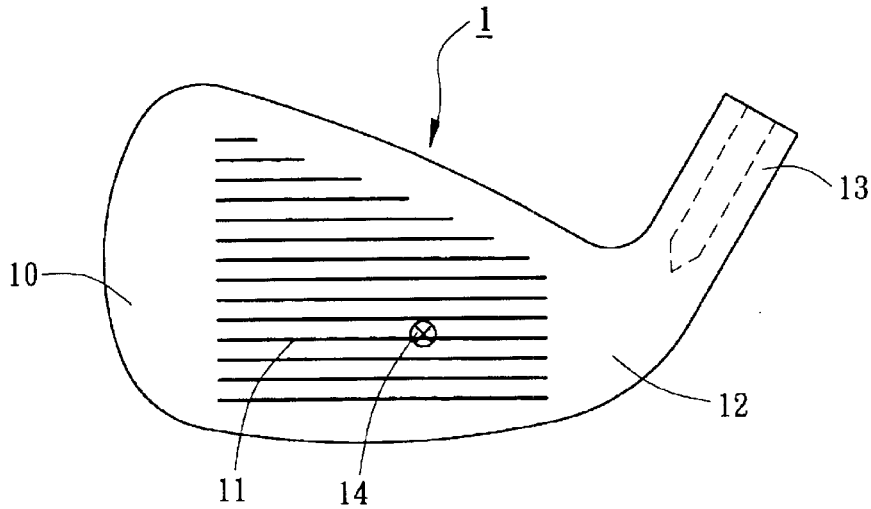
FIG. 1 PRIOR ART
FIG. 1 is a front view of a conventional golf club head.
Figure 2:
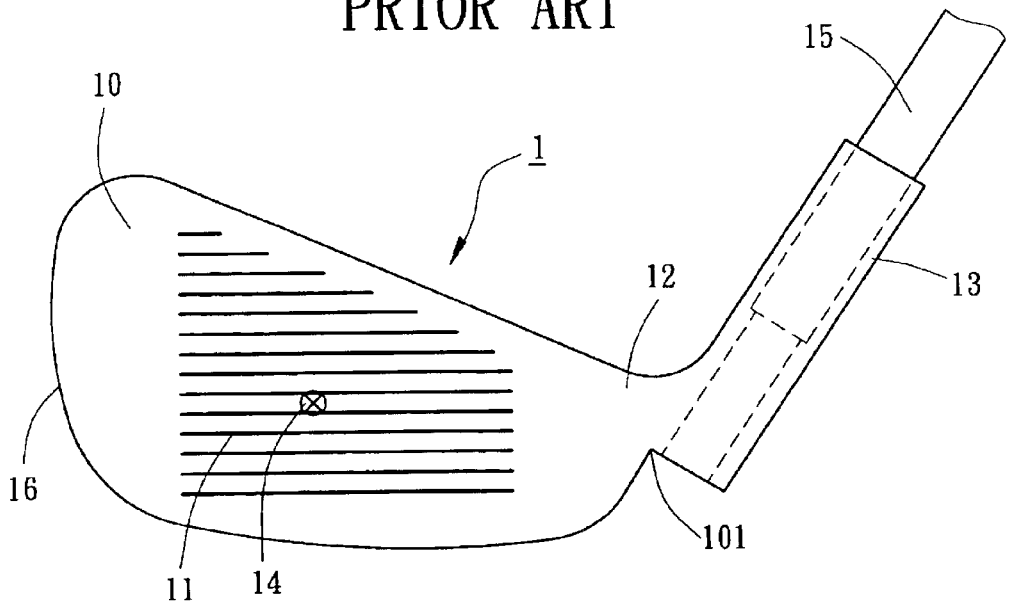
FIG. 2 PRIOR ART
FIG. 2 is a front view of another conventional golf club head.

Preferred embodiments of the present invention are now to be described hereinafter in detail, in which the same reference numerals are used in the preferred embodiments for the same parts as those in the prior art to avoid redundant description.

Figure 3:
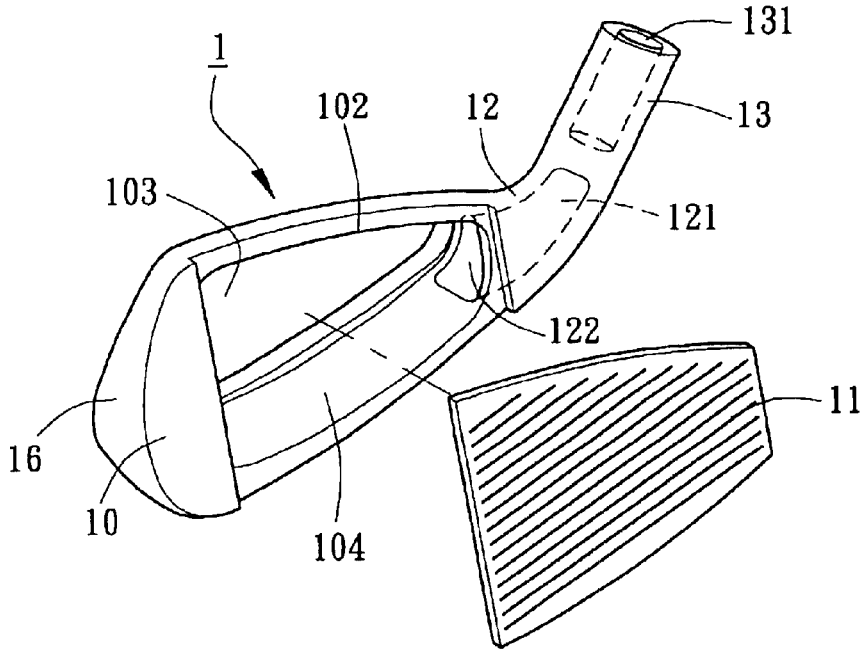
FIG. 3 is an exploded perspective view of a first embodiment of a golf club head in accordance with the present invention.
Figure 4:
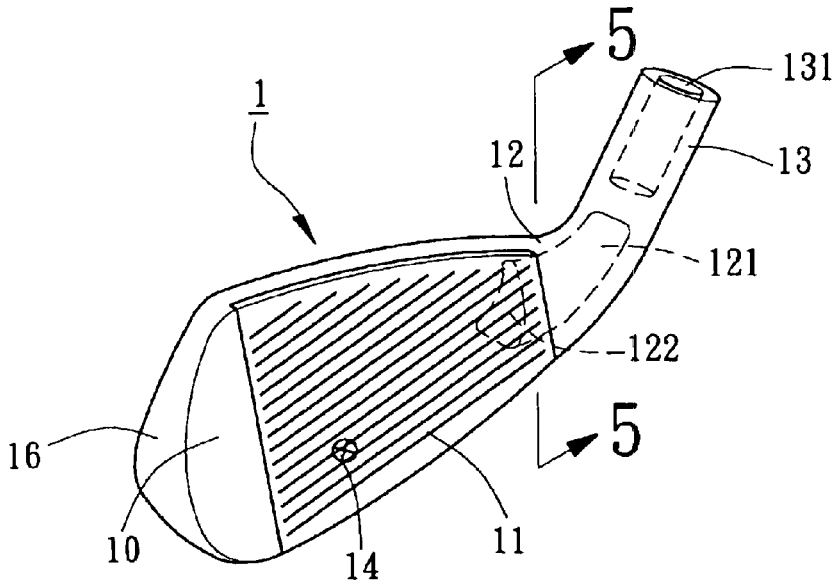
FIG. 4 is a perspective view of the first embodiment of the golf club head in accordance with the present invention.
Figure 5:
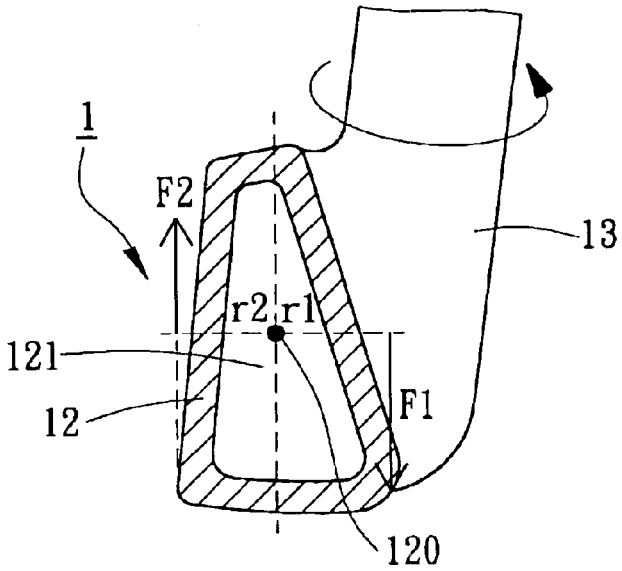
FIG. 5 is a sectional view taken along plane 5—5 in FIG. 4.

Referring to FIGS. 3 through 5, a first embodiment of a golf club head 1 in accordance with the present invention is made of metal or alloy and includes a golf club head body 10, a striking plate 11 for striking a golf ball, a hosel 13, and a heel 12 between the hosel 13 and the striking plate 11. The golf club head body 10 includes an engaging portion 102 in a front side thereof. In this embodiment, the engaging portion 102 includes a space 103 delimited by an inner peripheral wall 104. The striking plate 11 is integrally formed with the engaging portion 102 of the golf club head body 10. Alternatively, the striking plate 11 is engaged with the engaging portion 101 of the golf club head body 10 by means of insertion, pressing, brazing, welding, screwing, etc.

The heel 12 includes a compartment 121 defined therein for reducing the weight of the heel 12. The compartment 121 reduces the weight of the heel 12. Thus, the center of gravity 14 of the golf club head 1 is shifted toward a toe 16 of the golf club head 1; namely, away from the heel 12. The inertial moment of the golf club head 10 is increased, and the striking effect is improved (i.e., the flying distance of a golf ball stricken by the golf club head 1 is increased). The compartment 122 may include an opening 122 that is communicated with the space 103 of the engaging portion 102. The hosel 13 includes an engaging hole 131 for engaging with an end of a shaft (not shown). The compartment 121 of the heel 12 may extend to a position adjacent to a bottom end wall (not labeled) delimiting the engaging hole 131 of the hosel 13.

As illustrated in FIG. 5, when the heel 12 exerts a torque F as a result of striking a golf ball (not shown) by the golf club head 1, the torque F causes twist of the heel 12 and the hosel 13. Each point on the section of the heel 12 creates an active force F1, F2, which creates a momentum with respect to a geometric center of the heel 12. A point distal to the heel 12 has a longer arm of force, and a point adjacent to the heel 12 has a shorter arm of force (see r1, r2). Thus, most part of momentum created by the torque F is distributed to the outermost wall portion of the heel 12. Thus, although the heel 12 is hollow (due to provision of the compartment 121), the inner peripheral wall delimiting the compartment 121 provides sufficient reaction forces to completely counterbalance the momentum created by the torque F. Namely, the heel 12 possesses sufficient structural strength and rigidity. Further, the compartment 121 of the heel 12 is delimited by a plurality of wall sections that have an identical wall thickness. This allows the heel 12 to uniformly withstand the torque F, thereby reducing the possibility of twist and deformation of the heel 12 resulting from non-uniform torque distribution.

The heel 12 and the hosel 13 may be integrally formed on a side of the golf club head body 10 by means of precision casting, forging, integral formation, casting, mechanical processing, press casting, molding injection, etc. Alternatively, the heel 12 and the hosel 13 are engaged to the golf club head 10 by means of section-by-section engagement.

Figure 6:
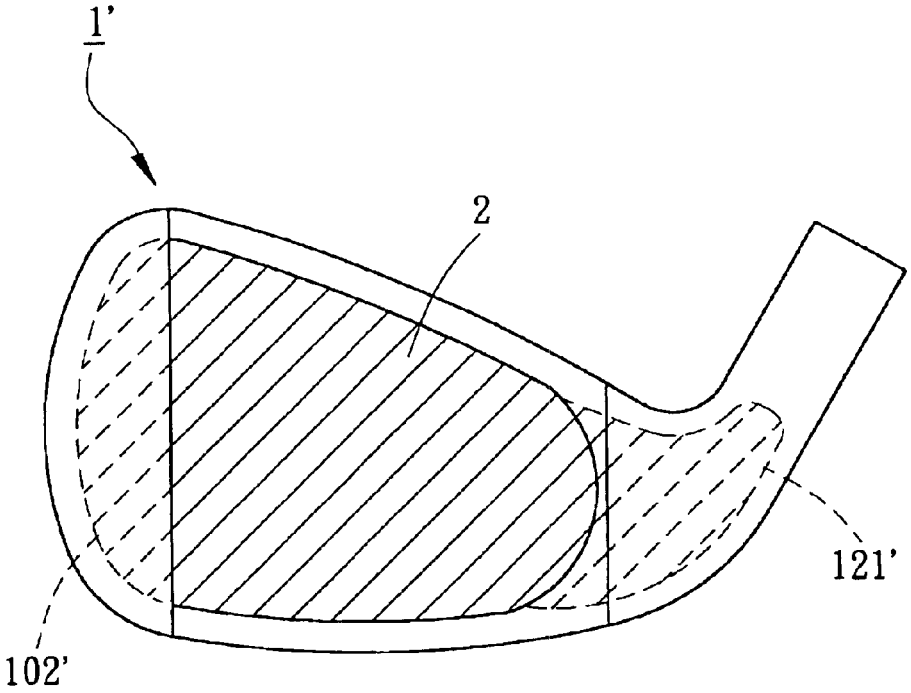
FIG. 6 is a schematic view, partly sectioned, showing formation of a wax mold for manufacturing the golf club head in accordance with the present invention.

Referring to FIG. 6, the golf club head 1 can be manufactured by means of using a wax pattern to provide an integrally formed structure. Firstly, a wax pattern 1' with a predetermined shape of a golf club head 1 is made, with a sand core 2 being embedded in the wax pattern 1'. The sand core 2 has a contour complementary to that of the compartment 121' and to that of the engaging portion 102'. A ceramic shell (not shown) is made and directly engaged with the sand core 2. Iron melt is poured into the ceramic shell and forms a cast of the golf club head 1. Next, the ceramic shell and the sand core 2 are removed, obtaining a golf club head 1 with a compartment 121 and an engaging portion 102.

Figure 7:
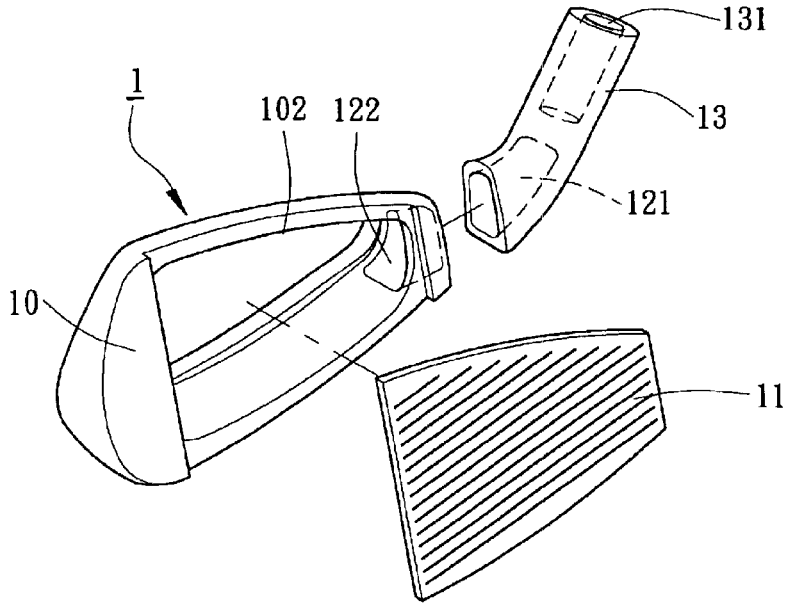
FIG. 7 is an exploded perspective view illustrating casts for manufacturing the first embodiment of the golf club head in accordance with the present invention.

Referring to FIG. 7, the golf club head body 10, the striking plate 11, the heel 12, and the hosel 13 can be separately manufactured by precision casting, which allows easy formation of the compartment 121 in the heel 12. Next, the golf club head body 10, the striking plate 11, the heel 12, and the hosel 13 are welded together by section-by-section welding, providing a golf club head 1 with a compartment 121.

Figure 8:
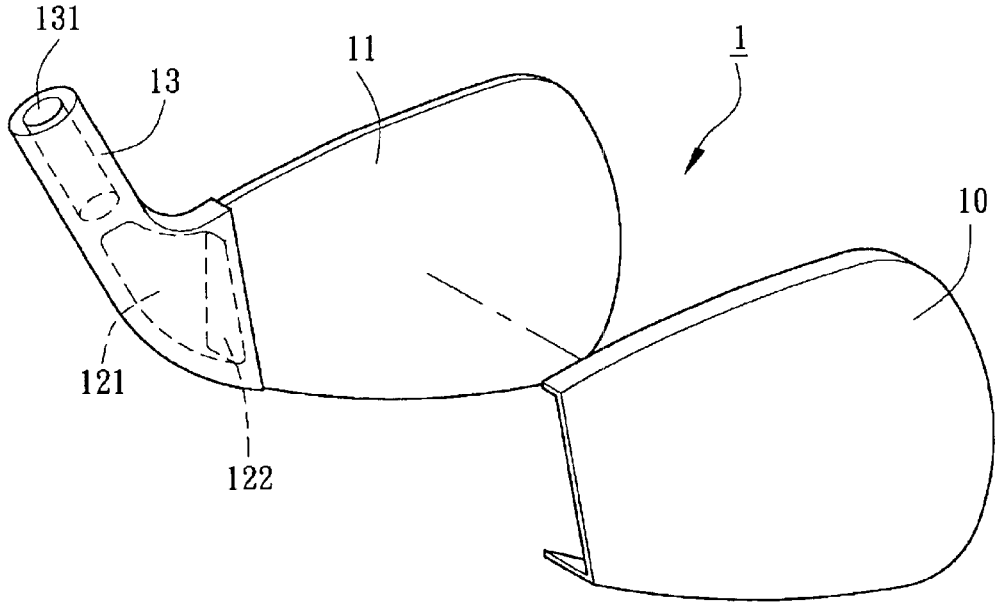
FIG. 8 is an exploded perspective view illustrating forging pieces for manufacturing the first embodiment of the golf club head in accordance with the present invention.

Referring to FIG. 8, the golf club head body 10, the striking plate 11, the heel 12, and the hosel 13 can be separately manufactured by forging. Next, the golf club head body 10, the striking plate 11, the heel 12, and the hosel 13 are welded together by section-by-section welding, providing a golf club head 1 with a compartment 121. During forging, the golf club head body 10 is preferably pressed to form a substantially U-shaped member, and the striking plate 11, the heel 12, and the hosel 13 are preferably of the same forging piece. The compartment 121 is formed in the heel 12 by means of drilling or pre-casting.

Figure 9:
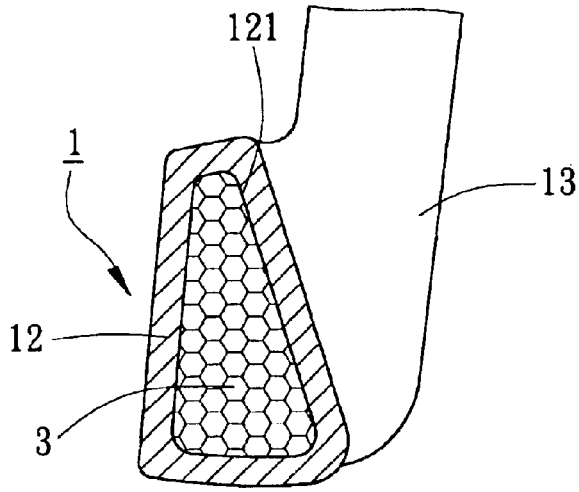
FIG. 9 is a view similar to FIG. 5, illustrating a second embodiment of the golf club head in accordance with the present invention.

FIG. 9 illustrates a second embodiment of the invention, wherein a filling material 3 can be filled into the compartment 121 of the heel 12. Thus, the damping value of the heel 12 is increased by the filling material 3 without adversely affecting the structural strength and without reducing the momentum of the striking plate 11. The vibrations generated as a result of striking a golf ball are absorbed by the filling material 3, thereby improving the striking stability and the gripping comfort. The filling material 3 is a damping material selected from a group consisting of rubbers, emulsions, foam materials, liquids, gels, and epoxy resins that are capable of absorbing vibrations. In a case that the compartment 121 has an opening 122, the filling material 3 can be filled into a recessed portion (not labeled) defined by the engaging portion 102.

Figure 10:
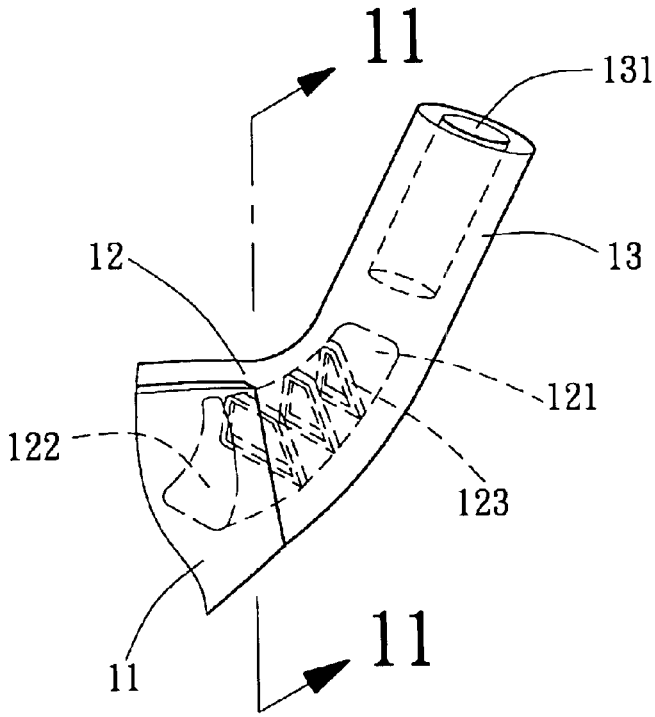
FIG. 10 is a perspective view, partly cutaway, of a third embodiment of the golf club head in accordance with the present invention.
Figure 11:
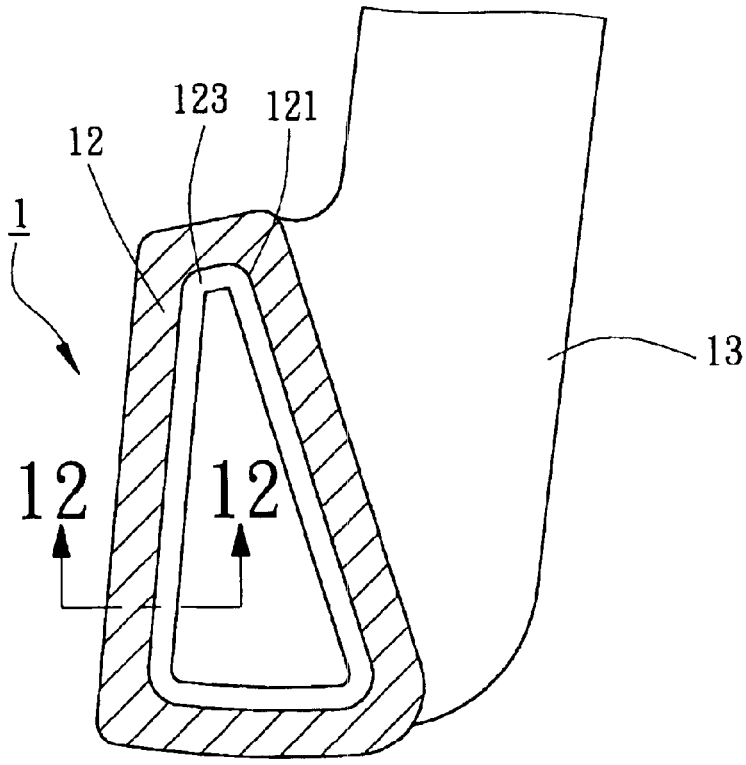
FIG. 11 is a sectional view taken along plane 11—11 in FIG. 10.
Figure 12:
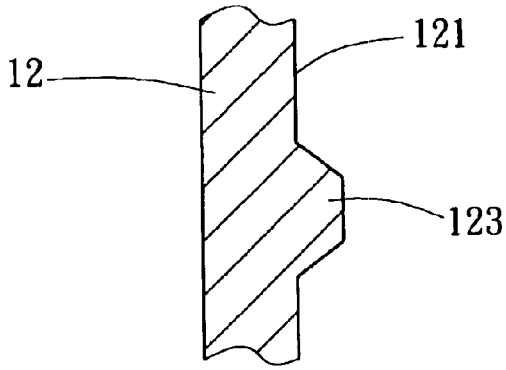
FIG. 12 is a sectional view taken along plane 12—12 in FIG. 11.

FIGS. 10 through 12 illustrate a third embodiment of the invention. In this embodiment, a plurality of flanges 123 are formed on the inner periphery delimiting the compartment 121 of the heel 12. Preferably, the respective flange 123 has a triangular or trapezoid section. The flanges 123 further strengthen the structure of the heel 12. The compartment 121 may also receive the filling material 3 in FIG. 9 for absorbing vibrations generated as a result of striking a golf ball.

Referring to FIGS. 5, 9, and 11, the thicknesses of the wall sections delimiting the compartment 121 of the heel 12 can be selected according to the need of the products. Namely, a larger compartment 121 is provided when the walls sections have small thicknesses, and more weight is reduced from the heel 12, causing further shifting of the center of gravity 14 of the golf club head 1 toward the toe 16. The inertial moment of the golf club head 1 is increased. In a case that the center of gravity 14 of the golf club head is to be shifted by a relatively smaller distance, the wall thicknesses are greater, providing a stronger structure.

In conclusion, the center of gravity 14 of the golf club head 1 in accordance with the present invention is shifted outwardly toward the toe 16 without adversely affecting the strength of the golf club head 1, which cannot be achieved by the prior art golf club heads. Shifting of the center of gravity 14 of the golf club head 1 is achieved by providing a compartment 121 in the heel 12. Further, the inertial moment of the golf club head 1 and the adjustment range of the center of gravity 14 of the golf club head 1 are increased, while the striking effect, the vibration-absorbing capacity, and the structural strength of the golf club head 1 are improved.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A golf club head, comprising:

a golf club head body having a toe and an inner peripheral wall, the inner peripheral wall being along a portion of a circumference of the golf club head;

a striking plate mounted to a front side of the golf club head body, a rear cavity being an area surrounded by the toe, the strike plate, and the inner peripheral wall;

a hosel mounted to a side of the golf club head body, the hosel being adapted to engage with a shaft; and a heel disposed between the hosel and the striking plate, the heel including a compartment for reducing a weight of the heel, thereby shifting a center of gravity of the golf club head toward the toe of the golf club head body, the compartment having an opening located in the rear cavity and on the inner peripheral wall to communicate the compartment with the rear cavity of the golf club head body.

2. The golf club head as claimed in claim 1, wherein the compartment of the heel are delimited by a plurality of wall sections having an identical wall thickness.

3. The golf club head as claimed in claim 1, further including a plurality of flanges formed on an inner periphery delimiting the compartment of the heel.

4. The golf club head as claimed in claim 1, further including a filling material received in the compartment of the heel for absorbing vibrations generated as a result of striking a golf ball.

5. The golf club head as claimed in claim 4, wherein the filling material is a damping material selected from a group consisting of rubbers, emulsions, foam materials, liquids, gels, and epoxy resins that are capable of absorbing vibrations.

6. The golf club head as claimed in claim 1, wherein the heel and the hosel are formed on the side of the golf club head body by one of precision casting, forging, integral formation, casting, mechanical processing, press casting, and injection molding.

7. The golf club head as claimed in claim 1, wherein the heel and the hosel are engaged to the side of the golf club head body by means of section-by-section engagement.

8. The golf club head as claimed in claim 1, wherein the golf club head body includes an engaging portion to which the striking plate is mounted.

9. The golf club head body as claimed in claim 8, wherein the engaging portion includes a space delimited by an inner periphery, the opening communicating with the space of the engaging portion.

10. The golf club head as claimed in claim 9, further including a filling material received in the compartment of the heel for absorbing vibrations generated as a result of striking a golf ball.

11. The golf club head as claimed in claim 10, wherein the filling material is a damping material selected from a group consisting of rubbers, emulsions, foam materials, liquids, gels, and epoxy resins that are capable of absorbing vibrations.

12. The golf club head as claimed in claim 3, further including a filling material received in the compartment of the heel for absorbing vibrations generated as a result of striking a golf ball.

13. The golf club head as claimed in claim 12, wherein the filling material is a damping material selected from a group consisting of rubbers, emulsions, foam materials, liquids, gels, and epoxy resins that are capable of absorbing vibrations.

* * * * *